US005147055A

United States Patent [19]

Samson et al.

[11] Patent Number: 5,147,055

[45] Date of Patent: Sep. 15, 1992

[54] DIAPER CONTAINER

[75] Inventors: Jeffery T. Samson; Roy E. Knoedler, both of Boulder; Patrick M. Bertsch, Littleton, all of Colo.

[73] Assignee: Gerry Baby Products Company, Denver, Colo.

[21] Appl. No.: 755,013

[22] Filed: Sep. 4, 1991

[51] Int. Cl.[5] ..... B65D 51/18

[52] U.S. Cl. ..... 220/254; 220/259; 220/252; 220/263; 220/908; 220/404; 220/324

[58] Field of Search ..... 220/908, 259, 324, 254, 220/256, 404, 408, 410, 252, 262, 263, 909, 910

[56] References Cited

U.S. PATENT DOCUMENTS

| | | | |
|---|---|---|---|
| 918,295 | 4/1990 | Doane | 220/259 X |
| 1,227,463 | 5/1917 | Luyties | 220/259 X |
| 1,976,270 | 10/1934 | Engels | 220/259 |
| 2,411,430 | 11/1946 | Hodson | 220/908 X |
| 2,533,524 | 12/1950 | Snider | 220/908 X |
| 4,598,838 | 7/1986 | Zakrajsek | 220/908 X |
| 4,649,813 | 3/1987 | Kehl | 230/908 X |
| 4,673,100 | 6/1987 | Reis et al. | 220/324 |
| 4,691,841 | 9/1987 | Sussman | 220/404 |
| 4,776,478 | 10/1988 | Miller et al. | 220/908 X |
| 4,874,103 | 10/1989 | Quisenberry et al. | 220/908 X |
| 4,913,308 | 4/1990 | Culbertson | 220/908 X |
| 4,972,966 | 11/1990 | Craft, Jr. | 220/908 X |

*Primary Examiner*—Stephen Marcus
*Assistant Examiner*—Paul A. Schwarz
*Attorney, Agent, or Firm*—Biebel & French

[57] ABSTRACT

A diaper container is provided having an exterior lid and an interior flap member wherein the lid and flap member are each provided with a filter element. The lid member is pivoted at a rear edge thereof to open the container and the flap member is pivoted at a central portion thereof and covers an opening for receiving diapers into the container. The pivotal movement of the flap member is limited in order to control dispersion of odors from the container. In addition, the body of the container is configured with its longest dimension in the front to rear direction whereby the container may be placed within narrow passages.

20 Claims, 5 Drawing Sheets

DIAPER CONTAINER

BACKGROUND OF THE INVENTION

The present invention relates to containers for containing odors of materials stored within the containers and, more particularly, to containers for storing diapers wherein odors produced within the container are efficiently controlled.

Diapers are typically stored and accumulated within a container as they are used and, upon the container being filled, the diapers are then collectively disposed of. Often, the cumulative odor of the diapers being stored within the container reaches such an offensive level that the diapers must be disposed of before the container is full. This often results in excessive emptying operations of the container and the use of large quantities of container liners such as flexible bags, when such liners are used within the container.

U.S. Pat. No. 2,411,430 to Hodson discloses a solution to the above-identified problems and shows a diaper container including an odor absorbing material attached to a lid portion of the container. In addition, the container includes a foot pedal for lifting the lid to open the container.

While the device disclosed by Hodson effectively retains the odors within the container when the lid is closed, when one opens the lid, odors stored within the container will quickly escape into the surrounding environment. Also, as more diapers accumulate within the container, the strength of the odors escaping will also increase. Further, the container disclosed by Hodson is subject to inadvertently being opened such as when a toddler plays around the container and lifts up on the lid to allow odors to escape or a child may reach in and handle the soiled diapers.

Accordingly, there is a need for a diaper storage container which effectively retains the odors emanating from the diapers in order to minimize the offensive odors of materials within the container.

In addition, there is a need for a diaper storage container which may be easily opened without touching the lid of the container while also preventing toddlers or small children from opening the container.

SUMMARY OF THE INVENTION

The present invention provides a container for storing diapers wherein the container includes a body portion forming a receptacle for receiving the diapers and the body portion is defined by an upper edge opposing front and rear sides and opposing lateral sides connecting the front and rear sides.

The container further includes an outer lid and an interior flap carrying an activated charcoal filter to retain and absorb the odors within the container. The outer lid forms an exterior closure member over the body portion and includes a front and rear edge wherein the rear edge is attached to the body portion for pivotal movement and the front edge may be lifted away from the body portion to an open position.

A foot actuated lever is pivotally mounted within a recess formed in a lower surface of the body portion and when actuated opens the outer lid.

A locking mechanism is provided mounted on the front edge of the lid for engaging the front upper edge of the body portion to prevent the lid from being opened by a toddler. In addition, latching means are provided whereby the locking mechanism may be held in an unlocked position. Thus, before a diaper changing operation is initiated, the locking mechanism may be latched in an unlocked position such that the lid may be lifted to its open position without the necessity of manipulating the locking mechanism.

The interior flap includes front and rear portions and the flap is pivotally mounted relative to the body portion at a point between the front and rear portions. Means are provided for limiting the movement of the flap such that only the front portion may be pivoted downwardly into the body portion and the rear portion is prevented from pivoting downwardly past the top of the body portion. Thus, when a diaper is deposited in the container, the front portion of the flap will be pivoted downwardly to allow passage of the diaper while the rear portion will pivot upwardly whereby any odors contained within the container will be directed rearwardly and upwardly toward the interior surface of the outer lid which interior surface is provided with an activated charcoal filter for absorbing odors.

Another feature of the present invention relates to the dimensions of the body portion of the container in that the distance from the front to the rear sides of the body portion is greater than the distance between the opposing lateral sides such that a narrow container is provided for positioning in narrow spaces, such as between furniture. By providing a narrow container, the width of the opening for depositing the diapers may be kept small to minimize any passage of odors past the front portion of the flap. Also, the width of the passage at the rear of the container is kept narrow to minimize the passage area for the odors passing into contact with the odor absorbing filter on the lid. Further, by providing a long dimension between the front and rear sides, the overall capacity of the container for storing diapers is not affected by minimizing the width dimension.

Therefore, it is an object of the present invention to provide a diaper storage container including a lid having a locking mechanism which will prevent toddlers from opening the container.

It is another object of the invention to provide a container having an exterior lid and an interior flap such that two closure elements are provided to the container for containing odors.

It is another object of the invention to provide a separate odor absorbing element to each of the lid and the flap whereby odors are effectively prevented from escaping from the container when in a closed position.

It is yet another object of the invention to provide a construction wherein the movement of the interior flap is limited such that it may pivot only downwardly toward the front to thereby limit the dispersion of odors from the container.

It is a further object of the invention to provide a diaper storage container wherein the long dimension of the container extends in the front to rear direction such that the container may be placed in narrow spaces and to minimize the opening area of the lid and flap whereby odors are further contained within the container.

Other objects and advantages of the invention will be apparent from the following description, the accompanying drawings and the appended claims.

DETAILED DESCRIPTION OF THE PREFERRED EMBODIMENTS

Figure 1:
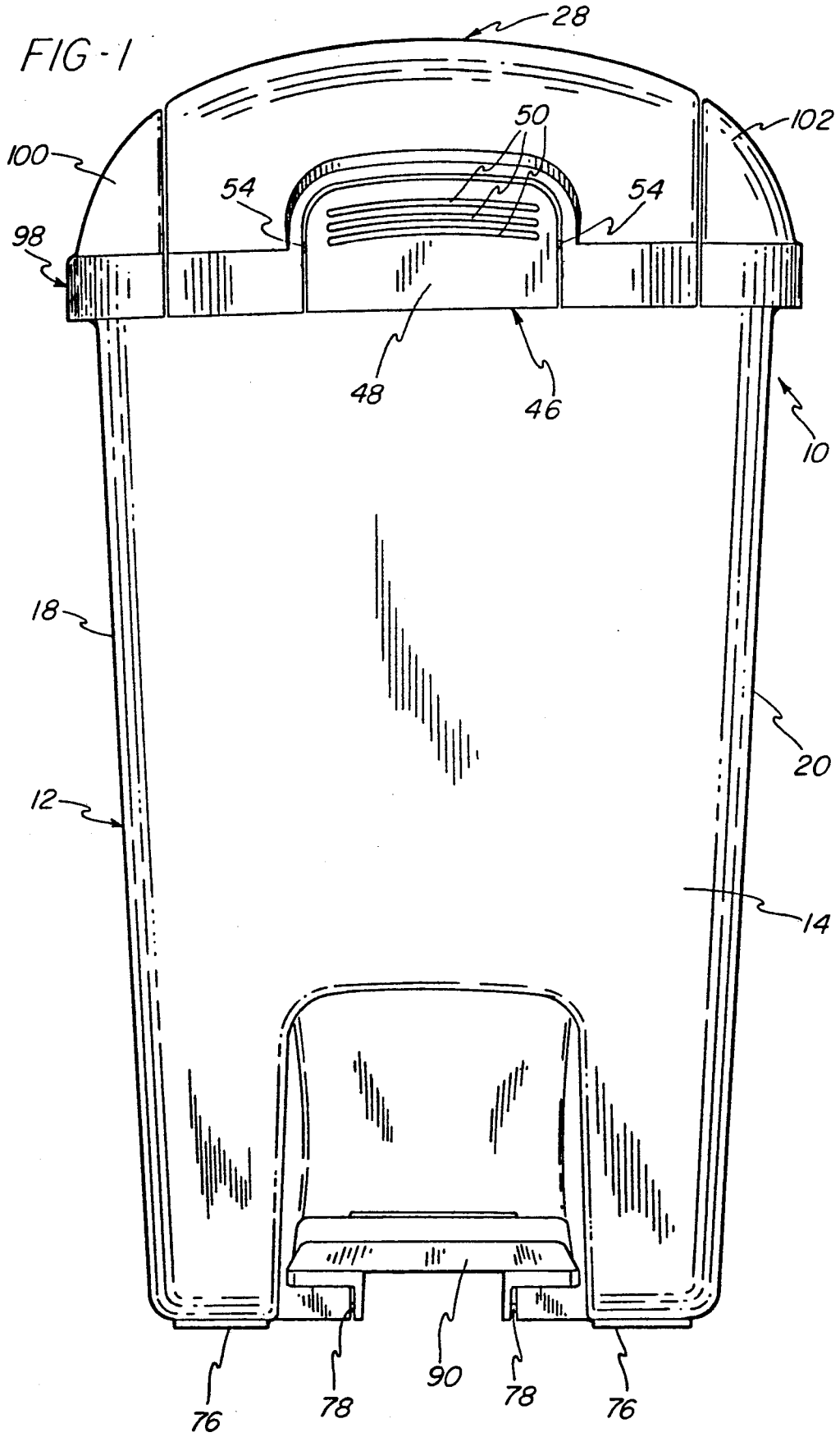
FIG. 1 is a front elevational view of the present invention.
Figure 2:
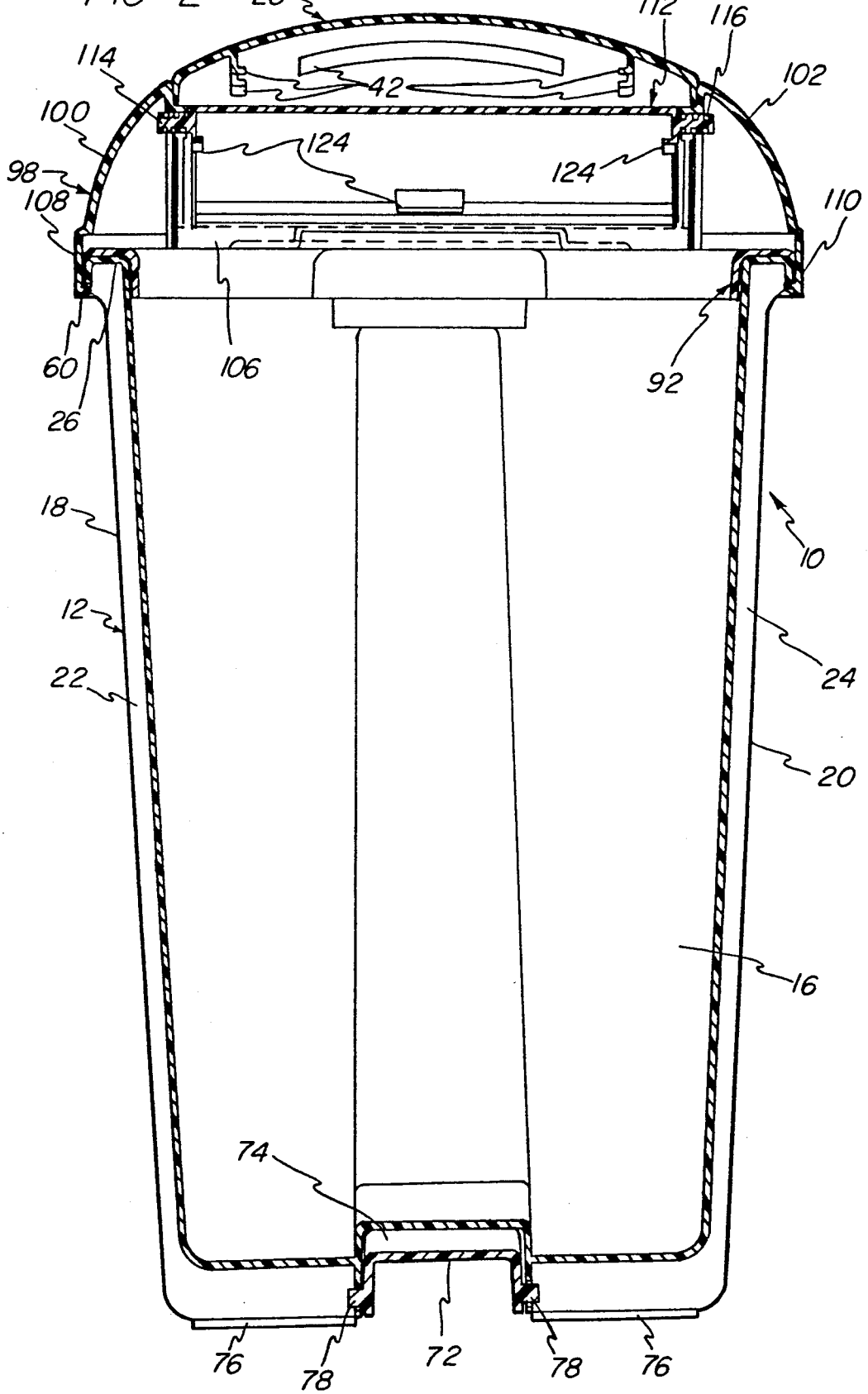
FIG. 2 is a front elevational view taken through a section midway between the front and rear sides of the container, and wherein the filter elements have been removed.

Referring to FIGS. 1–4, the diaper container 10 of the present invention includes a body portion 12 forming a receptacle for receiving diapers. The body portion 12 includes opposing front and rear sides 14, 16 and opposing left and right lateral sides 18, 20 connecting the front and rear sides 14, 16. It should be noted that the lateral sides 18, 20 each include an indentation 22, 24 extending upwardly from the base of the container to a flange portion 26 at the upper edge of the body portion 12 and the intersection of the indentations 22, 24 with the flange 26 define side handles in the body portion 12.

An outer lid 28 is located adjacent to the flange 26 and includes a pair of grooves 30 for receiving pins 32 formed integrally with a laterally extending lip 34 of the flange 26. The grooves 30 and pins 32 form a pivot point for the lid 28 whereby a front edge 36 of the lid 28 may be pivoted upwardly away from the front edge of the flange 26.

The lid 28 includes an exterior surface 38 and an interior surface 40 which surfaces define an arcuate shape for the lid 28 in a front to rear direction. The interior surface 40 of the lid 28 further includes filter holding projections 42 for holding a filter element 44 in position adjacent to the interior surface 40. The filter element 44 is preferably in the form of a conventional activated charcoal filter.

Figure 5:
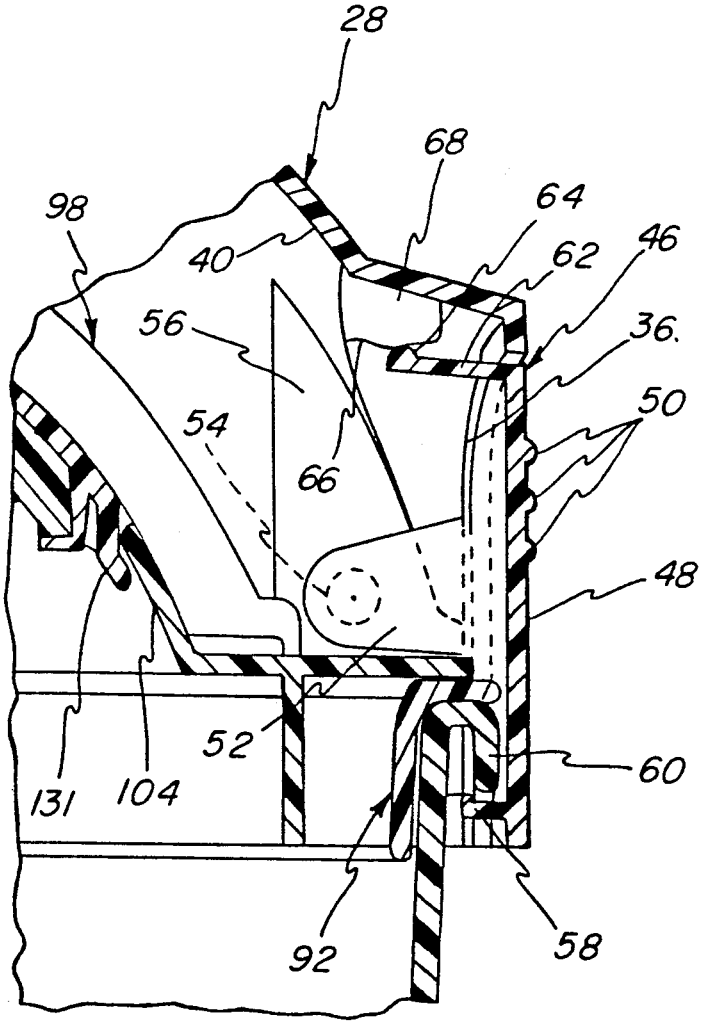
FIG. 5 is an enlarged view of the locking and latch mechanism in the position shown in FIG. 3.

Referring to FIG. 5, a locking mechanism 46 is located at the front edge 36 of the lid 28 and includes a manually operated body 48 which preferably includes a plurality of ribs 50 along an upper portion thereof to form a finger contact surface for facilitating manual operation of the lock 46. A pair of laterally spaced tabs 52 extend rearwardly from the body 48 and each tab 52 carries a pivot stud 54 which engages within a hole formed in a corresponding pivot support wall 56. Thus, the locking body 48 is free to pivot about the pins 54.

A locking lip 58 extends rearwardly from a point adjacent to a lower edge of the body 48 for engaging a downwardly extending lip portion 60 of the body portion flange 26. In addition, the lip 58 preferably includes a raised tab portion on the end thereof to facilitate maintaining the locking member 46 in a locked position with the lid 28 forming a closure over the body portion 12.

The locking mechanism 46 further includes means for latching the mechanism 46 in an unlocked position wherein the upper portion of the body 48 is pivoted inwardly. To this end, a pawl 62 extends rearwardly from the upper edge of the body 48 and includes an upwardly extending tab 64 for riding along a cam-like surface 66 defined on a projection 68 formed integrally with the interior surface 40 of the lid 28. A forward portion of the surface 66 angles rearwardly and slightly downwardly to provide a slight resistance to rearward movement of the pawl 62. As the pawl 62 is manually forced rearwardly by pressing on the upper surface of the body 48, it passes into an indentation formed in a rearward portion of the surface 66 where the tab 64 is retained such that the locking lip 58 is positioned in an outwardly pivoted location (see FIG. 4) where it will not engage the downwardly extending portion 60 of the flange 26.

In this manner, the locking mechanism 46 may be used to lock the lid 28 in a closed position to prevent a toddler from lifting the lid 28 of the container 10, and when it is either not necessary to lock the container in a closed position or when it is desirable to temporarily unlock the container for repeated opening and closing of the lid 28, the locking mechanism 46 may be located in its unlocked position to permit easy manipulation of the lid 28.

Figure 3:
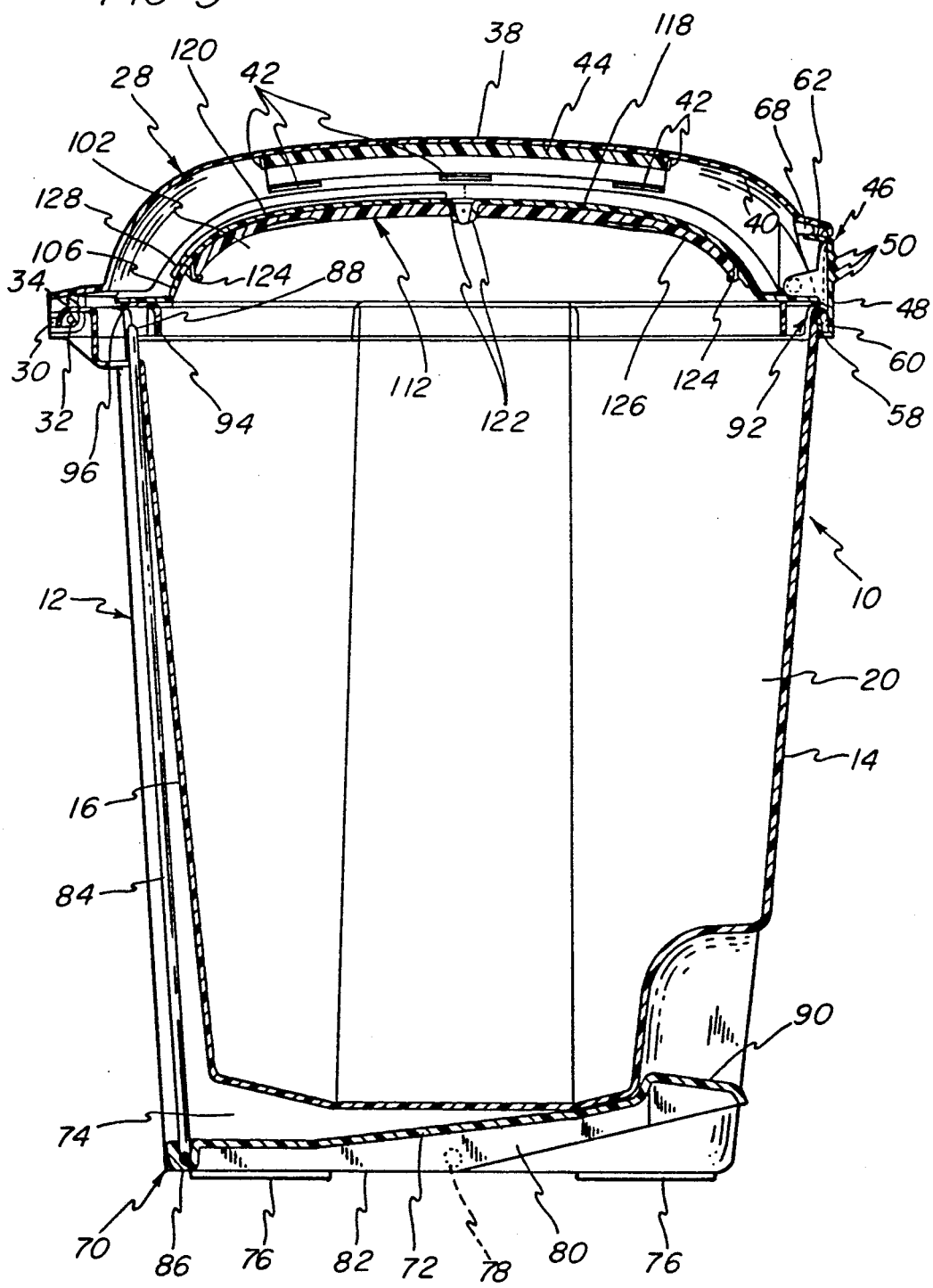
FIG. 3 is a side elevational view taken through a section midway between opposing lateral sides of the container.
Figure 4:
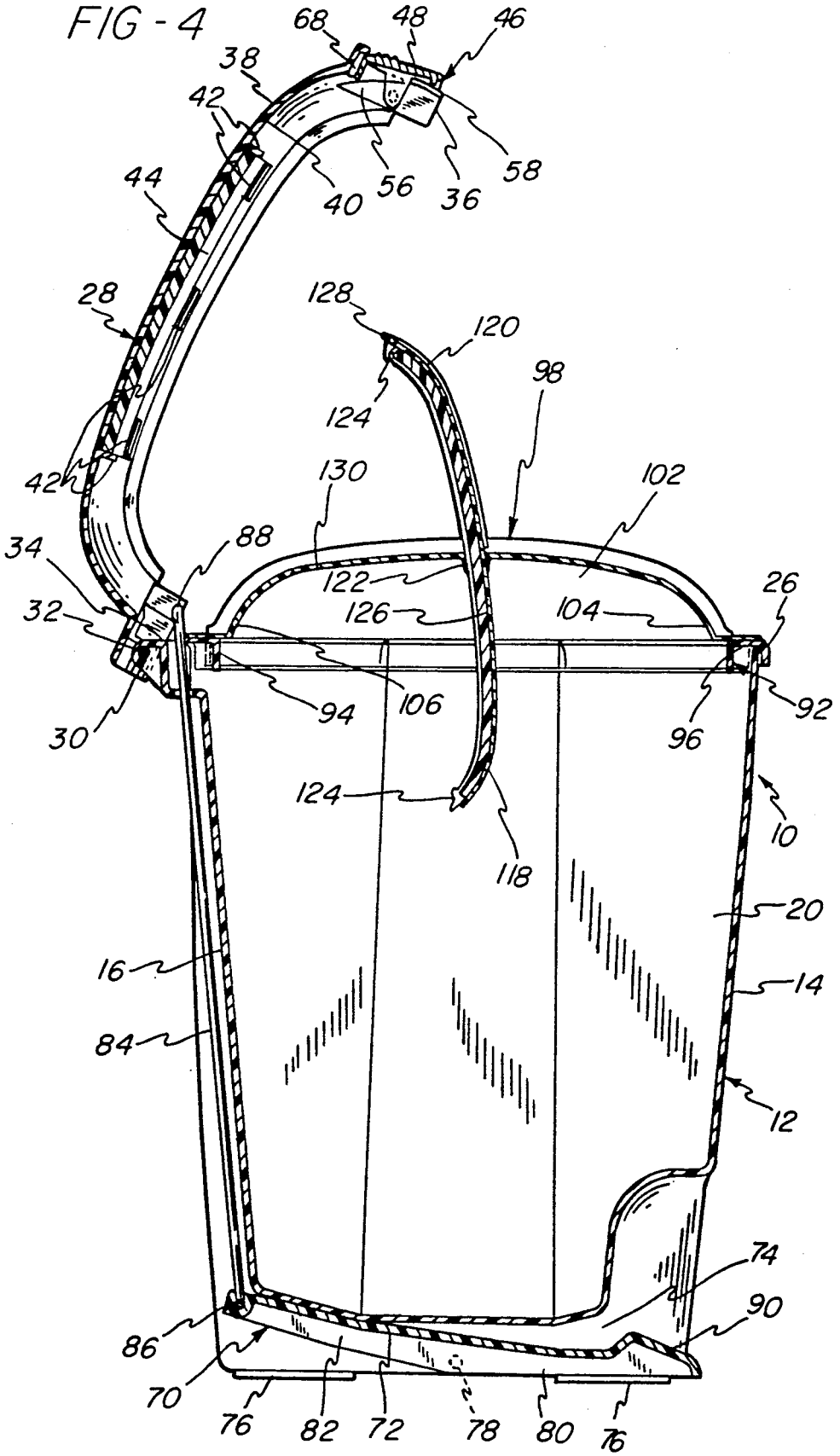
FIG. 4 is a view similar to FIG. 3 in which the lid and flap member are located in their open positions.

In order to facilitate opening of the lid 28, a foot actuated mechanism 70 is provided including a lever 72, as shown in FIGS. 3 and 4. The lever 72 is located within a tunnel 74 formed in a lower portion of the body portion 12 and extending rearwardly between the front and rear sides 14, 16 and positioned between supporting surfaces 76 formed at the bottom of the body portion 12 for supporting the container 10.

The lever 72 is mounted to the body portion 12 by means of pivot pins 78 formed integrally with the lever 72. It should be noted that the lever 72 is formed with a front arm 80 and a rear arm 82 wherein the lower surfaces of the arms 80, 82 define an obtuse angle relative to each other, and that the pivot pins 78 are located closely adjacent to the bottom of the body portion 12. By providing this particular location for the pins 78 and this construction for the lower surfaces of the arms 80, 82, the center of gravity for the pivot point defined by the pins 78 is kept a minimal distance from the supporting floor for the container. Further, the arms 80, 82 may be pivoted with their respective surfaces parallel to the floor at opposite extremities of the pivoting movement for the lever 72 and in this manner provides maximum lever movement with a minimum of instability for the container 10.

The lid 28 is actuated for movement by the lever 72 by means of a substantially vertical linkage member 84 extending from an engagement point 86 at a rearward portion of the rear arm 82. The linkage member 84 extends upwardly into engagement with a lower surface 88 formed in the lid 28 and at a point spaced from the pivot defined by the pins 32. Thus, when a person steps on a foot contact surface 90 formed on the lever 72, the linkage member 84 will be forced upwardly to open the lid 28, and when the force on the surface 90 is released, the weight of the lid 28 will again force the rear arm 82 downwardly and pivot the foot engaging surface 90 back to an upper position.

At this point, it should be noted that the body portion 12 is formed such that the distance between the front and rear sides 14, 16 is greater than the distance between the lateral sides 18, 20 to thereby form a narrow container having its elongated dimension in the front to rear direction. In the preferred embodiment, the body portion 12 has a lateral width dimension of approximately 10 to 11 inches, a front to rear length of approximately 16 to 17 inches and a height of approximately 17 to 18 inches.

Such a container configuration is conveniently placed in narrow spaces such as typically are available in rooms which are arranged as nurseries for children. In addition, by providing an elongated container in the front to rear direction, the stability of the container is improved during operation of the foot actuated lever 72 since a greater proportion of the weight of the container will be centered over the length of the lever 72 than in prior art containers whereby the possibility of the container tipping forward during operation of the lid lifting mechanism 70 is reduced.

A bag holding ring 92 is positioned within the upper edge defined by the flange 26 and includes a vertically extending wall 94 following the peripheral contour of the body portion 12 and a horizontal flange portion 96 extending radially outwardly from the vertical wall 94 for resting on the upper surface of the body portion 12. In use, the upper edge of a flexible plastic bag is positioned extending through the bag retaining ring 92 and draped over the horizontal flange 96. The ring 92 is then snapped into place on the body portion 12 with the edge of the plastic bag extending back into the container 10 such that it is pinched between the retaining ring 92 and the body portion 12 to thereby hold the bag in place.

A cover member 98 is positioned over the bag retaining ring 92 and extends around the periphery of the upper edge of the body portion 12. The cover member 98 includes a pair of lateral portions 100, 102 which extend arcuately upwardly in a direction from the front side 14 to the rear side 16 and each lateral portion 100, 102 includes a laterally inwardly located edge having a contour matching a laterally outwardly located edge of the lid 28 whereby the upper surface of the container 10 is formed as a relatively smooth continuously contoured surface.

The cover member 98 includes front and rear connecting portions 104, 106 which extend across the front and rear of the body portion upper surface and connect the lateral portions 100, 102. The front and rear portions 104, 106 together with the lateral portions 100, 102 define an opening for receiving diapers into the receptacle defined by the body portion 12.

The cover member is held in place by clip members 108, 110 which extend downwardly from the lateral portions 100, 102 to engage the lower surface of the downwardly extending lip 60 at the lateral sides of the body portion 12. Thus, the clip members 108, 110 may be snapped down over the lips 60 on opposing sides of the container to fix the cover member 98 in position.

An interior flap 112 is supported by the cover member 98 and includes a pair of pins 114, 116 located between front and rear portions 118, 120 of the flap 112. The pins 114, 116 are received within pivot openings defined by opposing tangs 122 formed integrally with each of the lateral portions 100, 102. In this manner, the flap 112 is mounted for pivotal movement within the opening defined between the front and rear portions 104, 106 and the lateral portions 100, 102 to act as a closure over the opening into the receptacle formed by the body portion 12.

The flap 112 includes integrally formed tabs 124 similar to the members 42 formed in the lid 28 and the tabs 124 are adapted to retain an activated charcoal filter 126 or other odor absorbing means within the interior surface of the flap 112. It should be noted that the front and rear portions 118, 120 of the flap 112 are arcuately curved in a shape to conform to the curvature of the lateral portions 100, 102 of the cover member 98 to thereby minimize any gaps formed between the cover member 98 and the flap 112.

In addition, a lip 128 is provided extending outwardly from the rear flap portion 120 and is adapted to engage the top surface of the rear cover portion 106 as well as laterally inwardly extending ledges 130 formed integrally with the lateral portions 100, 102 to thereby limit the downward pivoting movement of the rear flap portion 120. In this manner, the movement of the flap 112 is limited such that only the front flap portion 118 may pivot downwardly into the body portion 12 resulting in the rear flap portion 120 pivoting upwardly to direct any odors retained within the body portion rearwardly and upwardly toward the filter element 44 located within the lid 28. Further, by limiting the movement of the flap 112, the flap 112 is prevented from spinning when a diaper is dropped through the opening into the body portion 12 which spinning action can result in odors being fanned outwardly and dispersed into the surrounding environment.

Further, a forward lip 131 (see FIG. 5) is provided on the flap 112 for engaging the front connecting portion 104 whereby odors are prevented from flowing past the front portion 118 when the flap is closed, and to further limit upward movement of the flap 112.

It should be noted that the opening defined by the cover 98 and the flap member 112 which closes the opening are configured such that their dimension in the front to rear direction is approximately one and a half times the dimension in the lateral direction such that the opening at the front for receiving diapers is kept small to minimize odor leakage through this portion of the opening and the opening at the rear flap portion 120 is also thereby minimized. The flap of the preferred embodiment is formed having a width dimension of approximately 7½ inches and a length of approximately 11½ inches.

From the above description, it should be apparent that the storage container of the present invention provides means whereby primary odor containment is obtained through the flap member 112 and its associated filter element 126, and secondary odor containment is obtained through the lid 28 and its filter element 44 whereby odors escaping to the environment surrounding the container 10 are minimized.

Further, by providing an interior flap element 112 in which the movement of the element 112 is limited, any odors escaping from within the receptacle defined by the body portion 12 are directed upwardly onto the lid filter element 44. Additionally, the flap element 112 is prevented from spinning and acting to fan odors out of the container and into the surrounding environment.

Also, by providing a locking and latching mechanism for the lid of the container, toddlers and other small children are prevented from obtaining access to soiled diapers within the container and are further prevented from opening the container to allow odors to emanate therefrom.

It should also be noted that a particularly useful feature of the present invention resides in the use of a bag retaining ring 92 in combination with a removable cover portion 98 whereby a bag full of diapers may be removed from the body portion 12 after the cover portion 98 is lifted from its position and the necessity of removing the lid 28 before bag removal is avoided.

Finally, by providing the container of the present invention with a narrow construction having an elongated dimension in the front to rear direction, the container may be placed within narrow passages and the stability of the container during operation of the foot actuated lid opening mechanism is improved.

While the form of apparatus herein described constitutes a preferred embodiment of the invention, it is to be understood that the invention is not limited to this precise form of apparatus and that changes may be made therein without departing from the scope of the invention which is defined in the appended claims.

What is claimed is:

1. A container for storing diapers comprising:

a container body portion forming a receptacle for receiving diapers, said body portion having an upper edge, a lower edge and front and rear sides, an outer lid forming a closure over said body portion and having an exterior and an interior surface and a front and a rear edge, a pivot mounting for supporting said rear edge for pivotal movement such that said front edge may be lifted away from said body portion to an open position, first odor absorbing means attached to said interior surface of said outer lid, an interior flap located adjacent to said upper edge and forming an odor barrier between said body portion and said lid, said flap including a front portion and a rear portion, pivot means for mounting said flap for pivotal movement intermediate said front and rear portions, a bag retaining ring extending around the periphery of said upper edge such that a bag may be held in position within said body portion by said retaining ring, and a cover member removably positioned over said retaining ring, said pivot means including surfaces formed on said cover member for engaging cooperating surfaces on said flap.

2. The container of claim 1, including locking means movable between a locked and an unlocked position, said locking means acting to prevent said front edge of said lid from being lifted away from said body portion when said locking means is in said locked position.

3. The container of claim 2, including latching means for holding said locking means in said unlocked position.

4. The container of claim 1, including an actuator for opening said lid, said actuator comprising an elongated pivot lever having front and rear arms, a connecting link connecting said rear arm to said lid and a pivot point located between said front and rear arms for attaching said actuator adjacent to a lower portion of said body portion, said pivot point being located substantially equidistant from said front and rear sides of said body portion.

5. The container of claim 4, wherein said front and rear arms each include a lower surface and said lower surfaces of said front and rear arms define an obtuse angle relative to each other.

6. The container of claim 5, wherein said lower surface of said rear arm is adapted to extend parallel to said lower edge of said body portion when said lid is closed and said lower surface of said front arm is adapted to extend parallel to said lower edge of said body portion when said lid is lifted to said open position.

7. The container of claim 1 including limiting means for preventing said rear portion of said flap from pivoting into said body portion, said limiting means comprising a raised lip extending laterally outwardly from a peripheral edge of said flap for contacting a cooperating surface located in stationary relationship to said body portion.

8. The container of claim 1, including second odor absorbing means mounted on said flap and facing into the receptacle formed by said body portion.

9. The container of claim 1, including limiting means for limiting the pivotal movement of said flap such that said flap is prevented from pivoting with said rear portion extending into said body portion and said flap may pivot with said front portion extending into said body portion and said rear portion extending upwardly whereby odors passing from said body portion will be guided by said rear portion rearwardly and upwardly into contact with said first odor absorbing means.

10. A container for storing diapers comprising:

a container body portion forming a receptacle for receiving diapers, said body portion having an upper edge, opposing front and rear sides and opposing lateral sides connecting said front and rear sides, an outer lid forming a closure over said body portion and having an exterior and an interior surface, front and rear edges adjacent to said front and rear sides, respectively, and opposing lateral edges extending between said front and rear edges, a pivot mounting for supporting said outer lid at said rear edge for pivotal movement such that said front edge may be lifted away from said body portion to an open position, a cover member extending around the periphery of said upper edge and including lateral portions located laterally outwardly from said opposing lateral edges of said outer lid, said lateral portions extending accurately upwardly from said front to said rear side above said upper edge to form a seal between said upper edge and said lateral edges of said outer lid, and wherein the distance between said front and rear sides is greater than the distance between said lateral sides at said upper edge whereby said container may be positioned within narrow openings.

11. The container of claim 10, including an interior flap located adjacent to said upper edge and forming an odor barrier between said body portion and said lid, said flap including front, rear and opposing lateral sides defining a front portion and a rear portion wherein the distance between said front and rear sides is greater than the distance between said lateral sides.

12. The container of claim 11, including odor absorbing means attached to said interior surface of said lid, pivot means for mounting said flap for pivotal movement intermediate said front and rear portions and limiting means for limiting the pivotal movement of said flap such that said flap is prevented from pivoting with said rear portion extending into said body portion and said flap may pivot with said front portion extending into said body portion and said rear portion extending upwardly whereby odors passing from said body portion will be guided by said rear portion rearwardly and upwardly into contact with said odor absorbing means.

13. The container of claim 10, including locking means movable between a locked and an unlocked position, said locking means acting to prevent said front edge of said lid from being lifted away from said body portion when said locking means is in said locked position.

14. The container of claim 13, including latching means for holding said locking means in said unlocked position.

15. The container of claim 10, including an actuator for opening said lid, said actuator comprising an elongated pivot lever having front and rear arms, a connecting link connecting said rear arm to said lid adjacent to said rear side of said body portion, a pivot point for attaching said actuator adjacent to a lower portion of said body portion and a foot pedal mounted to said front arm adjacent to said front side of said body portion.

16. The container of claim 10, further including a flap and pivot means mounting said flap for pivotal movement adjacent to upper edges of said lateral portions, said pivot means including surfaces formed on said lateral portions for engaging cooperating surfaces on said flap.

17. The container of claim 16, including a retaining ring for retaining an upper edge of a bag positioned within said body portion, said retaining ring being located between said cover member and said body portion.

18. The container of claim 10, including a foot actuated lever extending from said front to said rear side for moving said lid to said open position, support portions formed in said body portion adjacent to said lateral sides for supporting said container on a floor surface and an upwardly extending tunnel formed in said body portion between said support portions for receiving said lever.

19. The container of claim 10, including an interior flap forming an odor barrier between said lid and said body portion, first odor absorbing means attached to said interior surface of said lid and second odor absorbing means attached to a lower surface of said flap facing into the receptacle defined by said body portion.

20. The container of claim 19, wherein said first and second odor absorbing means comprises activated charcoal.

* * * * *

UNITED STATES PATENT AND TRADEMARK OFFICE

CERTIFICATE OF CORRECTION

PATENT NO. : 5,147,055

DATED : September 15, 1992

INVENTOR(S) : Jeffery T. Samson et al

It is certified that error appears in the above-identified patent and that said Letters Patent is hereby corrected as shown below:

Column 8, line 33, "accurately" should be --arcuately--.

Signed and Sealed this

Twenty-first Day of September, 1993

Bruce Lehman

*Attest:*

BRUCE LEHMAN

*Attesting Officer*

*Commissioner of Patents and Trademarks*